US005319806A

United States Patent [19]

Hermann et al.

[11] Patent Number: 5,319,806

[45] Date of Patent: Jun. 14, 1994

[54] SHOULDER GUARD HARNESS

[75] Inventors: Jeffery A. Hermann, 2700 N. Rainbow Blvd. #1134, Las Vegas, Nev. 89102; April K. Herman, Las Vegas, Nev.

[73] Assignee: Jeffery Allen Hermann, Joplin, Mo.

[21] Appl. No.: 716,244

[22] Filed: Jun. 17, 1991

[51] Int. Cl.[5] ..... A41D 13/00

[52] U.S. Cl. ..... 2/2; 2/44; 2/45; 2/267; 2/268; 2/310; 2/328

[58] Field of Search ..... 2/2, 44, 45, 102, 267, 2/268, 310, 326, 327, 328; 224/259, 264, 265, 266, 201

[56] References Cited

U.S. PATENT DOCUMENTS

| | | | |
|---|---|---|---|
| 744,477 | 11/1903 | Bush | 2/2 |
| 745,007 | 11/1903 | Gamble | 2/2 |
| 1,111,012 | 9/1914 | Dunigan | 2/2 |
| 1,241,025 | 9/1917 | Sagerstrom | 2/2 |
| 2,014,991 | 9/1935 | Snyder | 2/2 |
| 2,986,738 | 6/1961 | Zubiate | 2/2 |
| 3,504,377 | 4/1970 | Biggs, Jr. et al. | 2/2 |
| 3,906,944 | 9/1975 | Christen | 128/133 |
| 4,353,133 | 10/1982 | Williams | 2/2 |
| 4,479,267 | 10/1984 | Radowsky, Jr. | 2/44 |
| 4,493,115 | 1/1985 | Maier et al. | 2/2 |
| 4,507,801 | 4/1985 | Kavanaugh | 2/2 |
| 4,680,813 | 7/1987 | Glaeser | 2/2 |
| 4,866,789 | 9/1989 | Dorm | 2/2 |
| 4,894,868 | 1/1990 | Christopher | 2/268 |
| 5,046,488 | 9/1991 | Schiek, Sr. | 2/44 |

FOREIGN PATENT DOCUMENTS

| | | | |
|---|---|---|---|
| 7632288 | 10/1976 | France | 128/133 |

*Primary Examiner*—Clifford D. Crowder
*Assistant Examiner*—Gloria Hale

[57] ABSTRACT

A Shoulder Protector Guard harness having a appearance as suspenders with attached shoulder pads to protect each shoulder of a wearer from bruises, lacerations and other injuries caused by heavy construction materials. Each pad is held in place by a vertical suspender strap at its front and back. The vertical straps attach to the wearer's belt or pants with clamps to hold the shoulder protector in place. A horizontal center strap attached to each vertical strap holds each vertical strap in place thereby assisting the secure placement of the shoulder pads on the shoulders of the wearer.

1 Claim, 3 Drawing Sheets

FIGURE 1.
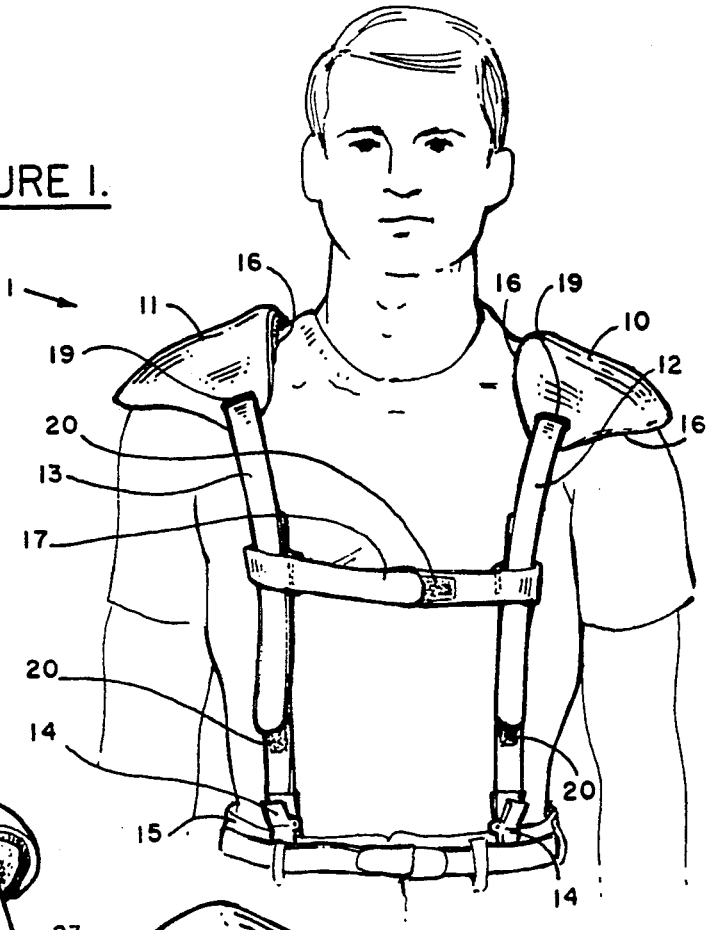
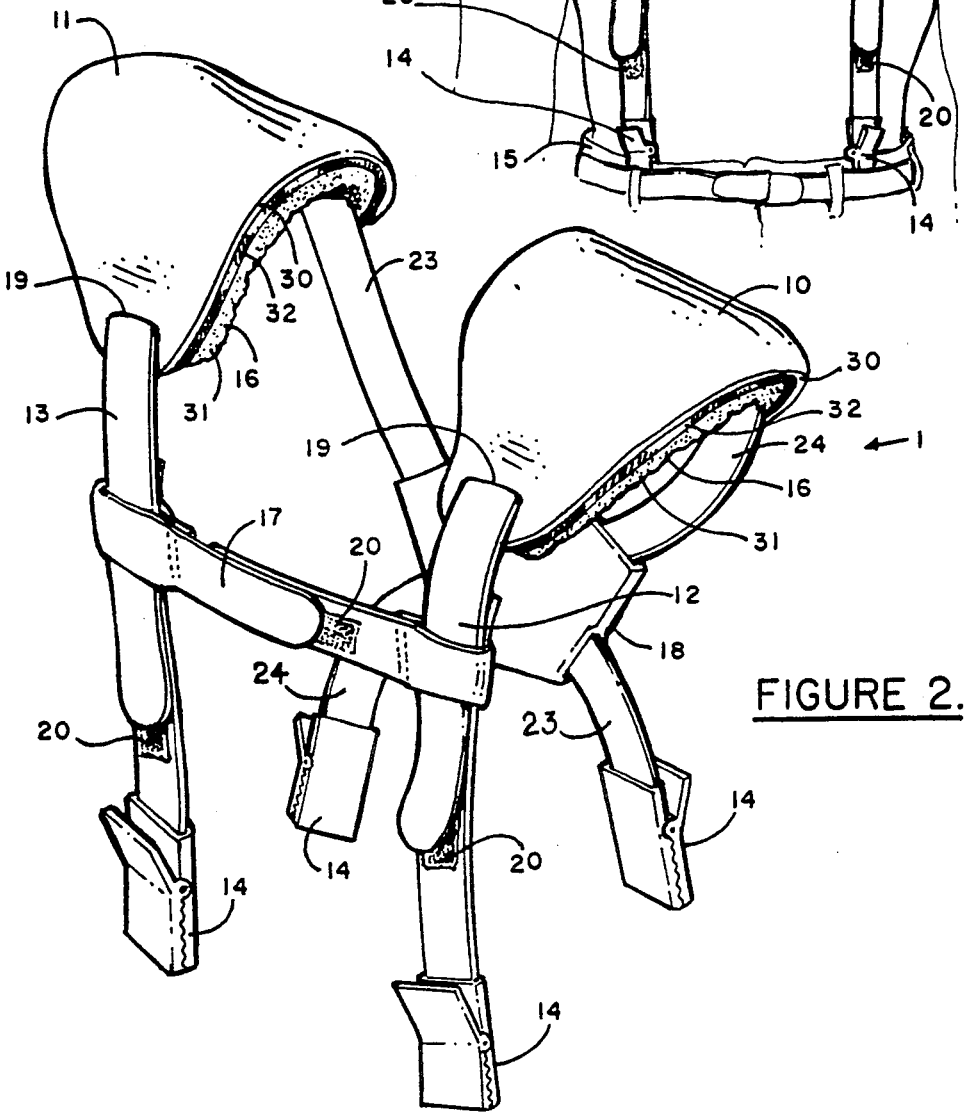
FIGURE 2.

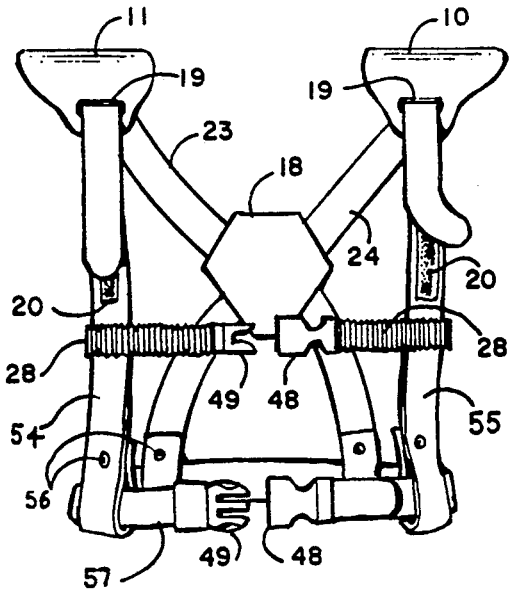
FIGURE 11.
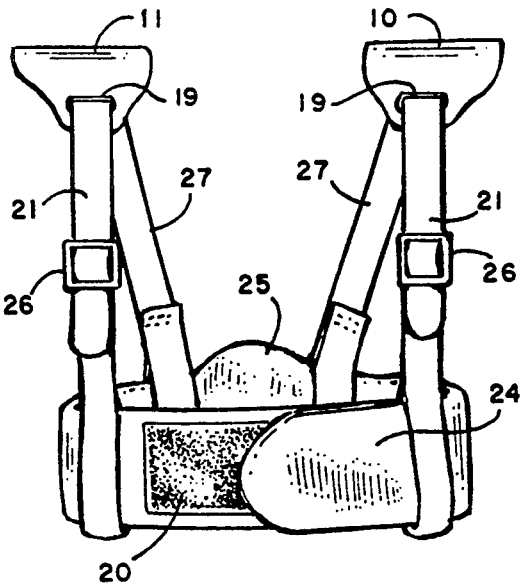
FIGURE 12.
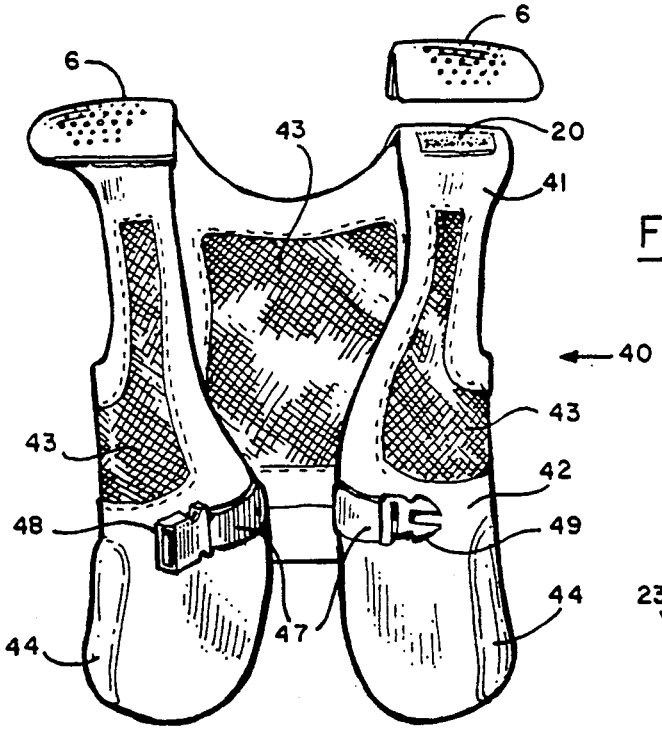
FIGURE 13.
FIGURE 14.
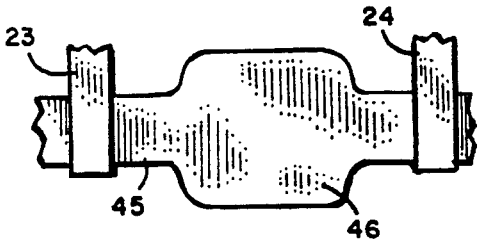
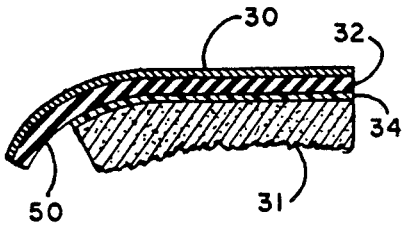
FIGURE 15.
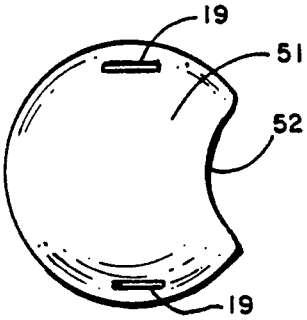
FIGURE 16.

SHOULDER GUARD HARNESS

SUMMARY OF THE INVENTION

The direct object of the invention is to facilitate and provide an updated body protector device especially engineered and designed for the use and need of the modern day heavy construction worker and their equipment.

In the present modern day construction and industrial industries, the occupations have far surpassed their predecessors in the production demands encountered during a normal days work activity. These increases have brought with it the need for certain implementation of many safety type devices.

The Shoulder Guard Harness protects the individual wearer from direct exposure to the harsh environmental hazards imposed on the shoulders of the modern day industrial worker.

The Shoulder Guard Harness has been built of specially designed components and shaped to accommodate the specific needs of mobility and protection for todays growing safety demands and stringent guidelines for the applicable industries.

BACKGROUND OF THE INVENTION

1. Field of the Invention

The present invention relates to upper body safety protective devices and protector garments. The invention of the Shoulder Guard Harness is for use by the modern day construction worker. Specifically this safety device is intended for use by Re-inforcing rebar steel workers (A.K.A.- Rodbusters), Ironworkers, Carpenters, Laborers, Carpenters helpers, Warehousemen and others, who while engaged in their work activity, transport building material, lumber stocks, rigid steel products and other heavy related objects which would bear directly on the shoulder region between the neck and the deltoid.

The Shoulder Guard Harness is comprised of two identically shaped insulator protector pads which are contoured to fit around either side of the neck resting atop the shoulder, as such with sufficient surface area to cover the weight bearing region of the shoulder. Additionally, the insulator protector pads are indirectly attached to a body harness which can be adjusted to fit a full scope of body sizes, as such the insulator protector pads freely conform to the individual wearer and their body contour. The body type harness is a fully adjustable unit that is comprised of nylon type webbing, elastomeric fabric, hook and loop fasteners, leather and rigid type hardware all of which are embodied and arranged to resemble and function similar to a suspender configuration. The harness can be attached to any craft tool holder belt, trouser belt, safety belt and/or other safety gear adapted to fit around the wearer's waist.

The Shoulder Guard Harness as its main function acts as an accessory utility safety device to act as a weight distributor and/or to insulate the wearer from heat and cold transfer from objects carried on the shoulders that in the past have been unprotected from such exposure. Further, to guard the shoulder from exposure and contact abrading, chafing and muscle irritations imposed when heavy objects or loads are borne by the user in a continuous and repetitive manner. The use of the Shoulder Guard Harness will comfortize and make the transport of the aforementioned products less stressful on the modern day construction worker.

2. Description of the Prior Art

In retrospect, body protectors and body protector devices indeed have a long history in the prior art. And so acknowledged are examples of body protectors and devices which are described and shown in the following United States Patents: U.S. Pat. No. 745,007, to Gamble; U.S. Pat. No. 1,241,025 to Sagerstrom; U.S. Pat. No. 2,014,991 to Synder; U.S. Pat. No. 3,504,377 to Biggs, Jr. et al; U.S. Pat. No. 4,507,801 to Kavanagh et al; U.S. Pat. No. 4,866,789 to Dorm; U.S. Pat. No. 4,894,868 to Christopher; U.S. Pat. No. 4,493,115; U.S. Pat. No. 5,046,488 to Schick, Sr. and U.S. Pat. No. 4,680,813 to Glaeser. However, it is to be noted that the substantial number of the prior art body protective devices are not designed for or accommodate the related problems encountered by the modern day construction trade occupations referred to above, but rather are specifically designed for use by or related to problems encountered by athletes involved in contact sports, as fire arm recoil protectors, reflective shoulder straps, moisture shields, weight transfer devices, spinal support devices and body injury restraint harnesses. As such the prior art body protectors and garments do not facilitate or address the problems or the functional requirements of movement encountered by the aforementioned modern day occupational trades discussed in the Field of Invention herein.

Further, it is to be so noted that others of the prior art protective devices referred to above, while they are related to a specific use for occupations engaged in shoulder support of receptacles and alike rigid containers in the scope of refuse workers do not encompass the problems encountered by the modern construction workers of today. The configuration of the prior art noted in U.S. Pat. No. 4,680,813 is clearly not an adaptable accessory utility for the tool holder belts and alike safety equipment being worn per OSHA standards for the occupations referred to above in the Field of the Invention.

Yet further, it is to be noted that others in the prior art body protector devices referred to above, while they are related to occupations of similar type discussed in the Field of Invention, are related to occupational problems encountered by workers in a much earlier time in history, as such at the time standards of safety and production performance were much less and slower in contrast to the fast pace and high production performance and safety standards set for the industry in present day.

Still further, it is to be noted that others in prior art body protector devices referred to above, do not directly address the problems encountered by the occupations discussed in the Field of Invention and are not specifically designed for or are an acceptable adaptation to the tool belt holders, safety belts and alike equipment as required by OSHA standards for the day in the industry.

Furthermore, it is to be noted that others in the prior art body protective devices referred to above, do not address the problems encountered by modern construction workers when engaged in the transport of building materials which have been exposed to radiant sunlight and cold extremes. As such, these exposed materials can reach temperatures in excess of 200 degrees F. when exposed steel and iron rebar lay in the sun and are transported by the unprotected shoulder, the resultants range from skin burns, epidermal infections, recurring muscle tumors, calloused skin, blood vessel and capillary breakage, soreness, frostbite and over all damage to their clothing. In addition no evidence is made to claim of the prior art in reference to the insulation of heat and cold transfer as a result of the transporting of the aforementioned building materials and alike objects to the body contact point on the shoulder.

Still, it is to be noted that the prior art body protectors and devices in some cases call out for claims that describe their garments as to be used for cushion to carry loads upon the shoulder and that such devices in the prior art discussions make no claim of their device for use as a tool belt accessory. As such, these devices are not adaptable or would be considered as useful in their present form for utilization by the trades. And in as much of the prior art body protector devices referred to above, it is to be noted that the present invention superceeds all previous claims as a Shoulder Guard Harness specifically engineered and developed for the needs and problems encountered by the modern day construction worker and related occupational industry.

BRIEF DESCRIPTION OF THE DRAWINGS

FIG. 1 is a front view of an individual wearing a shoulder guard harness of the present invention in its typical adjustment and placement on the body and clamped to the trousers of the wearer.

FIG. 2 is a 45 degree side view of the shoulder guard harness embodiment showing its basic configuration and design.

FIG. 11 is a front view of the Shoulder Guard Harness using hook and loop vertical strap adjustment with belt loops at the bottom and an elastomeric fabric horizontal chest strap with high impact quick release type buckles on both the chest strap and the belt within the strap loops.

FIG. 12 is a front view of the Shoulder Guard Harness configuration using vertical adjusting straps with a slip lock type buckle and a belt loop at the bottom in which an adjustable hook and loop support type belt is provided. The vertical straps are not joined together in the rear as implied for its special adaptation.

FIG. 13 is a front view of a vest configuration with detachable insulator pads affixed by hook and loop fasteners. The mid portions of the device have vent type netting for air transfer and embodied hip protectors sewn in place at either side along with an elastomeric fabric closure strap with a high impact plastic quick release type buckle.

FIG. 14 shows an optional back brace that is fitted through the back shoulder straps.

FIG. 15 is a cross-section view of the pad showing the overhanging lip.

FIG. 16 is a top view of the basic insulator pad specifically showing the neck arc and strap openings.

DESCRIPTION OF THE PREFERRED EMBODIMENT

Figure 3:
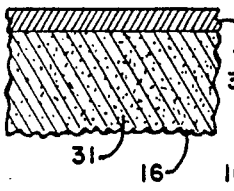
FIG. 3 is an exploded cross-section of the basic pad insulator design with two component construction.

Shown in FIG. 1 is the Shoulder Guard Harness (10, for use as a safety protector for those individuals who place heavy building materials and alike rigid objects such as iron rebar etc., atop their shoulder region which would otherwise be imperiled by contact from the aforementioned objects causing injury to the individual. The vertical straps (12,13,23 and 24) consist of heavy nylon type webbing, KEVLAR or fabrics of alike durable construction. The front left and right vertical straps (12 and 13) are embodied with positioned hook and loop fasteners which are sewn to a permanent position (20), there the overlapping outer left and right vertical straps are embodied with the mated hook and loop fastener on the under side (12,13). At the mid chest there is a center strap (17) which stabilizes the device from spreading apart during use and is affixed to the front left and right vertical straps (12,13) by providing a loop at each end of the center chest strap (17) and sewing into a fixed position. The center chest strap is divided into two overlapping straps (17) and is mate on the over and under side with hook and loop fasteners. As seen, the left and right vertical straps (12 and 13) enter through the provided openings 19, of the left and right shoulder insulator pads (10 and 11) in which the left and right vertical straps (12 and 13) can move inside a provided slot envelope from front to rear for adjustment in the left and right insulator pads (10 and 11). As further seen in FIGS. 3–6 the shoulder insulator pads 10 and 11 1, are of a multi-layer construction. FIG. 2 shows a 45 degree perspective view of the Shoulder Guard Harness, referring to the left and right shoulder insulator pads 10 and 11 as aforementioned are of multi-layered construction consisting of the inner liner being made of fleece or man made fabric (31), this being the cushioned surface next to the individual wearer (16). Further, these layers of construction comprise high density type foam (32). The layers are then positioned directly over eachother and sewn into a fixed position on the underside of the leather upper which is the wear surface (30). Exiting the rear of the shoulder insulator pads (10 and 11), through alike opening (19) are the rear left and right vertical straps (23 and 24) which cross diagonally over and under each other and at that intersection is provided leather or other man made fabric to be sewn to the inner and outer surfaces to construct the back yoke (18). Then the left and right vertical straps continue diagonally downward (23 and 24) to the belt or pants clamps (14). This particular section of the rear vertical straps extending downwardly diagonally (23 and 24), which extend between the yoke (18) and the pants(15) or belt clamps

(14) are constructed of elastomeric fabric (23 and 24). FIG. 3, shows a cross-section of the shoulder insulator pad, referring to the bottom layer which indicates the contact or cushion surface (16) and components of fleece or man-made fabric (31) and the upper layer component of leather which is the direct wear surface (30).

Figure 4:
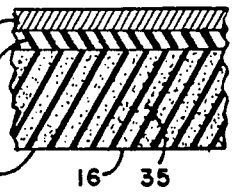
FIG. 4 is an exploded cross-section of the pad insulator designed with three component construction.
Figure 5:
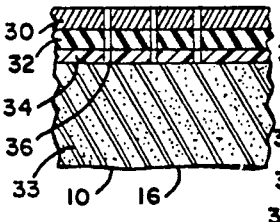
FIG. 5 is an exploded cross-section view of the pad insulator designed with four component construction with embodied air vent openings.

FIG. 4 is a cross-section of the shoulder insulator pad, referring to the bottom layer which indicates the contact or cushion surface (16) and component of man-made fabric (35), high density foam rubber (32) and component of leather which is the direct wear surface (30). FIG. 5 shows a cross-section of the modified shoulder insulator pad, referring to the bottom layer which indicates the contact or cushion surface (16) and component of man-made fabric (33), a component of high impact plastic which is pre-formed to the contour shape of the average shoulder convex (34), directly above is the component of high density foam or other man-made fabric to provide cushion 32, and the top component being the direct wear surface made of leather or alike durable fabric (30). In this embodiment of the shoulder insulator pad ha been designed with small air vent holes (36) to allow for circulation of air through the layers (30,32 and 34).

Figure 6:
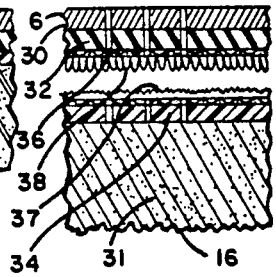
FIG. 6 is an exploded cross-section of the pad insulator designed with a six component construction separated with hook and loop type bonding surfaces and embodied air vent openings. The top section is removable.
Figure 7:
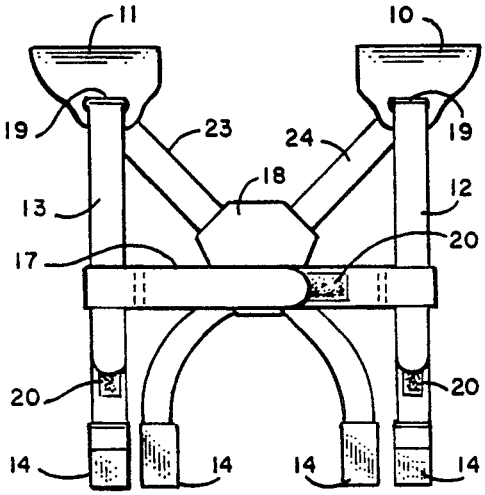
FIG. 7 is a front view of FIG. 1 in its basic design and configuration using hook and loop adjusting straps.
Figure 8:
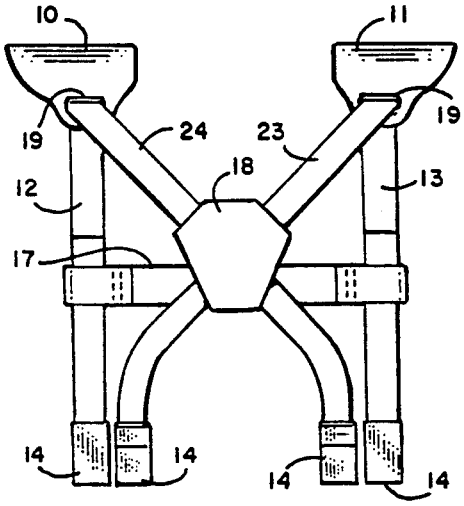
FIG. 8 is a rear view of FIG. 1 in its basic design and configuration using hook and loop adjusting straps.

FIG. 6 shows a modified shoulder insulator pad cross-section which would be used has a removable upper pad for use on the vest configuration (40). Beginning at the bottom with the contact or cushion surface (16), a component of fleece or man-made fabric (31), high impact plastic shield which contours to the shape of the shoulder convex (34), laminated and sewn to a fixed position on the loop fastener(37), above is the hook fastener which is sewn and laminated to a fixed position (38) to the under side of the upper insulator pad (6), being further constructed of high density foam (32) all of which in the upper portion of the shoulder insulator pad are laminated and sewn together to the leather wear surface (30) and have air holes (36) provided for circulation. FIG. 7 is a front perspective view of the shoulder guard harness and FIG. 8 is a rear perspective view.

Figure 9:
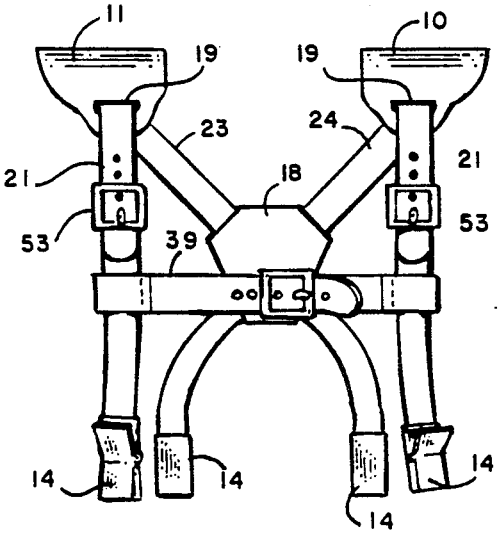
FIG. 9 is a front view of the Shoulder Guard Harness using buckle type hardware in the front straps for adjustment.

FIG. 9 is a front view of a modified shoulder guard harness using hook and eye buckles as hardware for adjustment. The front left and right vertical buckle straps are loop through the provided openings and affixed by sewing. The vertical straps in this configuration (21) are equipped with metal hook and eye buckles (53) which provide a opening for vertical strap to loop through and be sewn into position (21). At the front at mid chest elevation is the center chest strap buckle type (39) which is sewn into position and has the hook and eye buckle provided for adjustment (53). The center chest strap buckle (39) is looped around vertical strap (21) and sewn into position.

Figure 10:
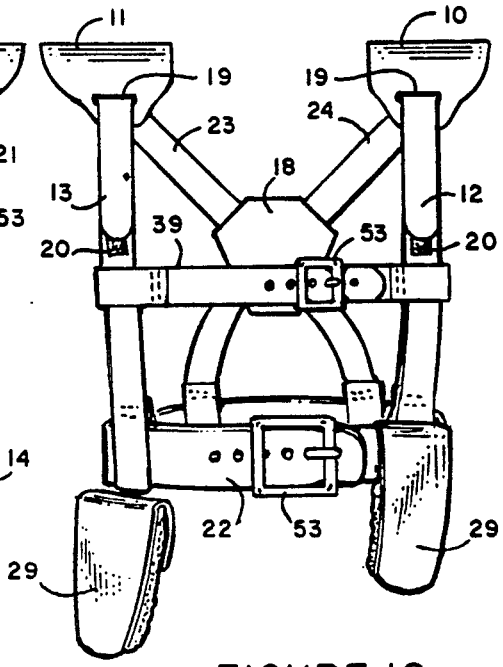
FIG. 10 is a front view of the Shoulder Guard Harness using buckle type hardware on the chest adjustment strap and hook and loop adjusting straps vertically with a looped bottom in which a work belt is provided along with the addition of a two component thigh protector of which is comprised of alike materials as the pad insulators above in FIGS. 3 and 4.

FIG. 10 shows a modified shoulder guard harness equipped to accept additional accessories. Safety is the primary objective of this protective device and as an additional safeguard this configuration has implemented the addition of thigh insulator pads which are looped at the top (29) to accept the work belt (22). The left and right thigh insulator pads (29) are made of identical component material as described for the shoulder insulator pads (10 and 11) and shown in FIGS. 3–6. The bottom waist belt (22) is of a standard work belt configuration using a hook and eye buckle for adjustment (53). The front left and right vertical straps (12 and 13) and the rear vertical straps which extend downward diagonally (23 and 24) are looped and sewn to accept the waist belt (22) to slide through. The center chest strap is equipped with the hook and eye buckle (39 and 53).

FIG. 11 shows another modification that has a waist belt (57) which provides a quick release buckle made of high-impact plastic male component(49)and female component (48). The vertical straps left and right (54,55) are looped at the bottom and riveted into a fixed position (56). The loop provided by the vertical straps left and right (54 and 55) allows for the waist belt to pass through (57). In this configuration, the adaptation of an elastomeric center chest strap which is sewn to (28), the front left and right vertical straps (54 and 55), the elastomeric center chest strap (28) is equipped with an affixed high impact plastic type quick release buckle female component (48) and male component(49). FIG. 12 shows a front view of a further modified version of the shoulder guard harness which is equipped with a wide lift cummerbund type waist belt (24) which overlaps in the front and is then locked into position with the placement of sewn on hook and loop fastener contact surfaces (20). The waist belt (24) has a widening at its center rear to give additional back support (25). The front and rear vertical straps are looped at the bottom (21 and 27) to accept the waist belt (24). The front left and right vertical straps (21) are equipped with slip lock type buckles for adjustment (26). In this configuration the rear left and right vertical straps remain independent of each other (27) and are looped at the bottom and sewn to accept the cummerbund Waist belt (24). FIG. 13 shows a front perspective of a vest configuration (40) having detachable shoulder insulator pads (6). The shoulder pad is shown in FIG. 6. The vest has side hip insulator (42) pads integral to the vest where the inner pad is constructed of high density type foam and fits in an envelope provided at the location indicated (44). The front strap is provided to close around the body (47) where the front strap has an adjustment located at the male high-impact plastic quick release type buckle (49) with the mate female buckle 48 attached to a fixed position to front strap (47). As a vest may become hot to wear in some conditions (42)fish net type panels on the left, right and rear sides (43) of the vest configuration (40) are added. The vest configuration would be constructed of KEVLAR or other man made durable fabrics (41). The fish net panels (43) would be permanently affixed by sewing them into their desired location (43) as an embodiment of the vest (42). Further, as an embodiment of this configuration sewn onto the top region of the vest (42) are left and right hook and loop fasteners (20). FIG. 6 shows the cross-section of the detachable shoulder insulator pad of the vest.

FIG. 14 shows an optional back brace that is fitted through the back shoulder straps.

FIG. 15 is a cross-section view of the pad showing the overhanging lip. FIG. 16 shows a top perspective of the shoulder insulator pad (51) having the neck arc to accommodate mobility and range of motion (52). The strap openings are provided at the front and rear(19) of the shoulder insulator pad (51). Cross-sections of the shoulder insulator pad are shown in FIGS. 3–6.

The invention as described, is susceptible to modification without departing from the inventive concept, and right is herein reserved to such modification as falls within the scope and equivalence of the appended claims:

I claim:

1. A shoulder protector for protection from articles carried on a wearer's shoulders comprising:

two parallel vertically aligned straps each having a first end located at about the front waist area of the wearer, extending up across the chest and over the shoulders, intersecting at the back area and having a second end located at about the rear waist area; a yoke covering the intersection of the straps at the back; a clamp on each end of the straps for attaching the straps to a lower body garment; a horizontal chest strap having loops at both ends to encircle the two vertically aligned chest straps for ensuring proper alignment of the vertically aligned chest straps; each of said horizontally and vertically aligned straps having a connector at the chest area for adjusting the fit of the protector on the wearer; and two shoulder pads each having apertures at both ends for the insertion of the vertically aligned straps; said shoulder pads comprised of three layers including an outer leather layer, a central high density foam layer and an inner man-made fabric layer for contact with the shoulder area of the wearer.

* * * * *

UNITED STATES PATENT AND TRADEMARK OFFICE

CERTIFICATE OF CORRECTION

PATENT NO. : 5,319,806

DATED : June 14, 1994

INVENTOR(S) : Hermann

It is certified that error appears in the above-indentified patent and that said Letters Patent is hereby corrected as shown below:

On the title page, Under item [19] delete "et al"
correct item [75] to read —Jeffery Hermann 504 Byers Ave
Japlin, MO 64801—

Signed and Sealed this

Thirteenth Day of September, 1994

*Attest:*

Bruce Lehman

BRUCE LEHMAN

*Attesting Officer*

*Commissioner of Patents and Trademarks*